US006273777B1

(12) United States Patent
Harris

(10) Patent No.: US 6,273,777 B1
(45) Date of Patent: Aug. 14, 2001

(54) BARREL TOY AND KIT

(76) Inventor: Clifton R. Harris, 4171 NW. 165th St., Reddick, Marion County, FL (US) 32686

( * ) Notice: Subject to any disclaimer, the term of this patent is extended or adjusted under 35 U.S.C. 154(b) by 0 days.

(21) Appl. No.: 09/426,511

(22) Filed: Oct. 26, 1999

(51) Int. Cl.[7] ..... A63H 33/00; A41D 11/00; A41D 13/00

(52) U.S. Cl. ..... 446/28; 2/69; 2/267

(58) Field of Search ..... 2/69, 92, 267, 2/463, 464; 446/26, 28, 71, 75, 76

(56) References Cited

U.S. PATENT DOCUMENTS

| | | | | |
|---|---|---|---|---|
| D. 290,727 | | 7/1987 | Rylands . | |
| 1,373,423 | * | 4/1921 | Gruhl . | |
| 3,125,762 | * | 3/1964 | Glahe . | |
| 3,693,283 | * | 9/1972 | Marcus | 446/28 |
| 3,972,526 | * | 8/1976 | Cox | 446/28 |
| 5,101,513 | * | 4/1992 | Bowers | 2/69 X |
| 5,209,691 | * | 5/1993 | Ekstein | 446/28 |
| 5,742,939 | * | 4/1998 | Williams | 446/28 X |
| 5,913,405 | * | 6/1999 | Bordier | 2/92 X |

* cited by examiner

*Primary Examiner*—John A. Ricci
(74) *Attorney, Agent, or Firm*—Locke Liddell & Sapp LLP; Monty L. Ross

(57) ABSTRACT

A barrel toy having a semi-rigid, generally cylindrical but slightly convex plastic sidewall with open top and bottom ends, interior and exterior surfaces, at least one unitarily molded, circumferentially extending rib, and an interior space sufficiently large to accommodate a child, a padded exterior surface section, a foam pad adhesively attached to the interior surface of the sidewall, and a decorative exterior covering. Also disclosed is a kit including a clown barrel toy in combination with a clown makeup case containing at least two different colors of facial makeup that can be safely applied to the facial skin of a child to emulate clown makeup, at least one makeup applicator device and at least one bulbous clown nose that can be temporarily applied to the nose of a child as part of the makeup.

12 Claims, 1 Drawing Sheet

BARREL TOY AND KIT

FIELD OF THE INVENTION

This invention relates to a barrel toy, and more particularly, to a barrel-shaped toy having a semi-rigid shell that is sufficiently large to accommodate the body of a child inside the toy. The invention further relates to a kit comprising the combination of a barrel toy with clown makeup, preferably including a bulbous clown nose.

BACKGROUND

The use of barrels by rodeo clowns is well known. During rodeos, and particularly during the bull-riding event, trained cowboys dressed as clowns are positioned on the ground inside the arena to distract the bull away from a rider who is thrown from the bull. By distracting the bull, the rodeo clowns are usually able to keep a bull from injuring or further injuring a downed rider before the rider can exit or be removed from the arena. Rodeo clowns typically work in pairs, including a bull fighter and a barrel man. The barrel man has a decorated steel barrel into which he can jump if charged by a bull. The barrels used by rodeo clowns must have sufficient wall thickness, hoop strength and rigidity that they will not buckle when butted or stepped on by a bull.

Because of the current popularity of rodeos and bull-riding as a spectator sport, often seen on television, these events are now witnessed and enjoyed by many children. Children are naturally attracted to the rodeo clowns because of their distinctive makeup, and also because of their antics when trying to distract a bull from a fallen cowboy. Because playing children like to emulate persons and events that attract their attention, a barrel toy and barrel toy kit are needed that will enable children to safely emulate the actions, activities and look of a rodeo barrel clown.

Conventional steel rodeo barrels are too large, heavy and expensive to be safely and satisfactorily used as a children's toy. If used by children during play, with one child inside the barrel and one child outside the barrel, the child outside the barrel could be crushed or suffer a broken limb if the barrel is tipped over or rolled onto to him or her. One clown in a barrel figure is disclosed in U.S. Pat. No. Des. 290,727, but the barrel disclosed in that patent is not signed in such manner that the barrel will accommodate the body of a child.

SUMMARY OF THE INVENTION

A barrel toy is disclosed herein that has an interior space built to accommodate the body of a child and that is light enough to be handled by children and used safely as a children's play toy.

According to one preferred embodiment of the invention, a barrel toy is provided that comprises a semi-rigid, generally cylindrical but slightly convex, plastic shell having open ends terminating in padded edges, a padded interior surface, and an exterior surface that is also preferably at least partially padded.

According to another preferred embodiment of the invention, the plastic shell of the subject barrel toy is ribbed to provide additional rigidity to the toy.

According to another preferred embodiment of the invention, the exterior surface of the barrel toy is covered with a decorative covering including colored tape and optional decals.

According to another embodiment of the invention, a kit is provided that includes both the barrel toy of the invention and a makeup case containing at least two different colors of facial makeup that can be safely applied to the facial skin of a child, at least one makeup applicator device and at least one removable bulbous nose that can be temporarily applied to the nose of a child as part of the makeup.

BRIEF DESCRIPTION OF THE DRAWINGS

The barrel toy and kit of the invention are further described and explained in relation to the following figures of the drawings, in which.

DESCRIPTION OF THE PREFERRED EMBODIMENTS

Figure 1:
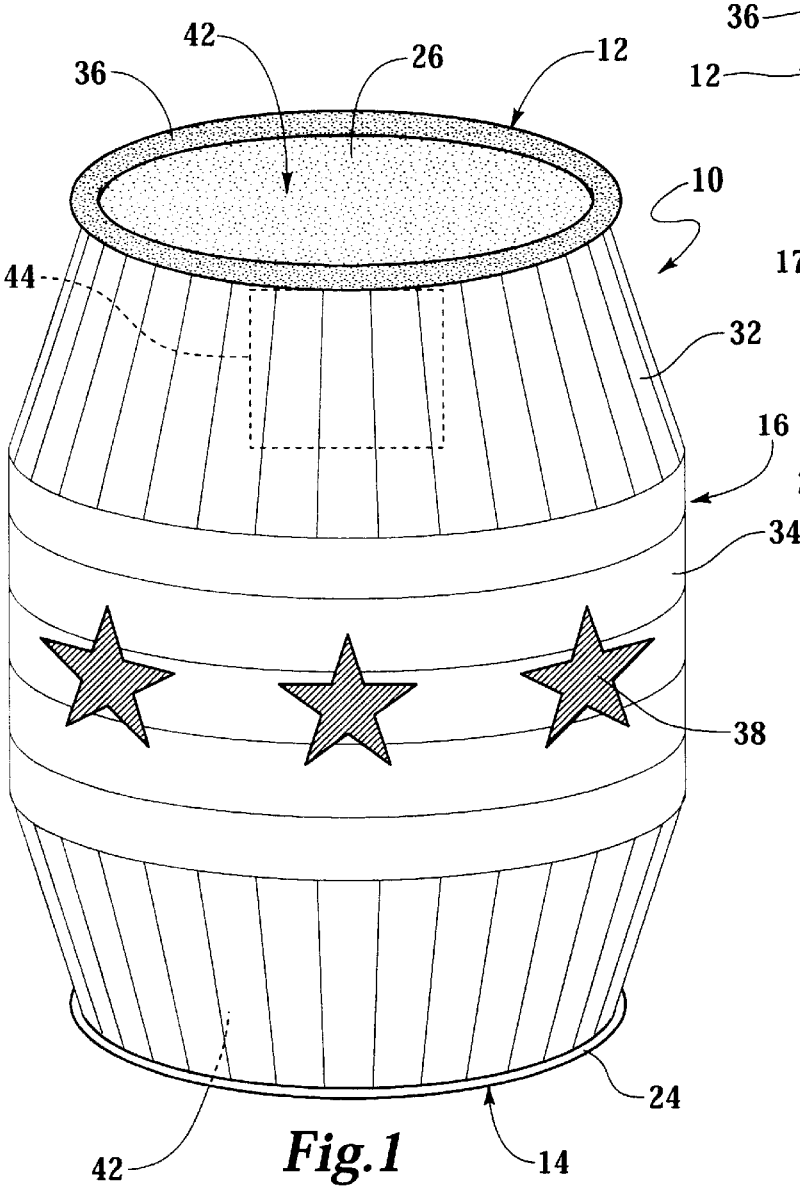
FIG. 1 is a top perspective view of a preferred barrel toy of the invention.
Figure 2:
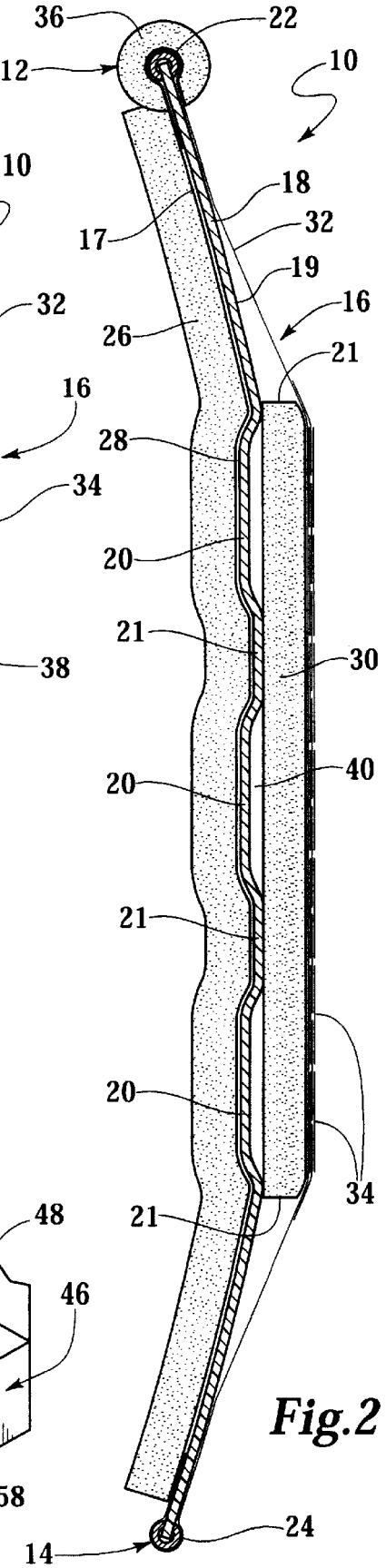
FIG. 2 is an enlarged cross-sectional elevation of the barrel toy of the invention.

Referring to FIGS. 1 and 2, barrel toy 10 of the invention preferably comprises a generally cylindrical but slightly convex barrel wall 16 terminating in open, preferably substantially circular, top end 12 and bottom end 14. Barrel wall 16 preferably comprises continuous sidewall 18, having interior surface 17, exterior surface 19, padded exterior and interior cushioning layers 26, 30, tape layers 32, 34, and optional decorative designs or decals 38.

Sidewall 18 is preferably molded from a thermoplastic resin that can be selected from the many well-known, commercially available resins that are satisfactory for such an application. Such resins can include, for example, olefinic polymers, or copolymers or terpolymers of olefins with other copolymerizable monomers. Acrylonitrile-butadiene-stryrene ("ABS") and so-called "engineered resins" can also be used within the scope of the invention where additional toughness or other properties are desired. Rotocast molding or extruded parison blow molding are two preferred methods for making sidewall 18 of barrel toy 10, although other similarly effective means can also be used within the scope of the invention.

Sidewall 18 preferably has a height and diameter such that the interior space 42 of barrel toy 10 defined by barrel wall 16 is sufficient to accommodate the whole body of a child. The thickness of sidewall 18 can vary, depending upon the particular plastic used and the geometry of the sidewall, but is desirably sufficient that barrel toy 10 can support the weight of at least one child without buckling and completely collapsing when in the vertical position shown in FIG. 1, and without collapsing against the diametrically opposed sidewall section when horizontal. A plurality of longitudinally spaced, circumferentially extending recessed ribs 20 can be unitarily molded into sidewall 18 if desired to increase the strength and resistance to collapse.

Flexible plastic tubing 22, 24, such as polyethylene or vinyl tubing, is desirably slit longitudinally and applied over the top and bottom ends, respectively, of sidewall 18 to pad the edges at the end of the sidewall and protect both the hands of the user and any tape 32 applied to the exterior surface of sidewall 18, as discussed below, from being cut or damaged by the edges. The length of tubing 22, 24 is desirably equal to the circumference of sidewall 18 at the top and bottom ends 12, 14. The inside diameter of tubing 22, 24 is desirably slightly greater than the thickness of that portion of sidewall 18 that is adjacent the ends. Tubing 22, 24 can be secured to top and bottom ends 12, 14 with an adhesive if desired, although the inherent memory of the extruded tubing is usually sufficient to cause the tubing to remain positioned on the ends of sidewall 18 until the tape 32 is applied.

An exterior cushion 30 formed from strips or a sheet of foamed rubber or plastic is desirably positioned around the outside of sidewall 18 to cover and pad the area having the greatest outside diameter. The principal purpose of cushion 30 is to soften the impact on someone either inside or under barrel toy 10 if it is tipped over during play. Where sidewall 18 is ribbed as shown in FIG. 2, cushion 30 will desirably extend across recessed ribs 20 and lands 21, with air spaces 40 therebetween. Cushion 30 can have either open-cell or closed-cell surfaces, or one closed cell surface and one open cell surface, or, if desired, another suitable padding material can be substituted for use as cushion 30.

Cushion 30 can be attached to the outside surface of sidewall 18 using an adhesive such as, for example, a spray adhesive, or can be held in position while a first layer of tape 32, 34 is applied in either a horizontal or vertical direction over cushion 30. According to a preferred embodiment of the invention, a first layer formed from strips of opaque, colored vinyl tape or duct tape is applied circumferentially around sidewall 18 over cushion 30, overlapping as desired. Vertically oriented strips 32 of opaque, colored tape can then be applied transverse to the first layer, wrapping over top and bottom ends 12, 14, respectively, thereby securing split tubing 22, 24 to sidewall 18. If desired, still another layer of horizontally oriented strips 34 of opaque tape can be applied to the exterior side of sidewall 18 as shown in FIGS. 1 and 2 to provide a decorative effect and further secure cushion 30 to sidewall 18 of barrel toy 10. Decorative designs or decals such as stars 38 can also be applied to the exterior surface of barrel toy 10, and overlaid with additional layers of transparent tape in either the horizontal or vertical direction, or both, as desired.

Following application of tape strips 32, 34 to sidewall 18, a length of longitudinally split, foamed polymeric tubing equal in length to the circumference of top end 12 is desirably applied over tape strips 32 and split tubing 22 to provide an additional cushion around sidewall 18 along top end 12. Split polypropylene foam tubing having a nominal outside diameter of about ¾ inch is generally satisfactory for use in this application, although other similarly effective materials can also be used within the scope of the invention if desired. The split tubing, most preferably having an annular cross-section and of the type frequently used to insulate lines in air conditioner compressor installations, can be permanently secured to top end 12 of barrel toy 10 with an adhesive if desired.

The inside surface of sidewall 18 is preferably provided with a substantially continuous cushioning layer 26 made of foamed polymeric material that is attached by a spray adhesive layer 28 or other similarly effective means to sidewall 18 of barrel toy 10. Cushioning layer 26 can be made of the same material as cushion 30, or of a different but similarly effective material if desired. Optionally, straps or hand-holds can also be provided, such as by riveting or other similarly effective means, to the inside of barrel wall 16 for use by a child playing inside barrel toy 10.

Figure 3:
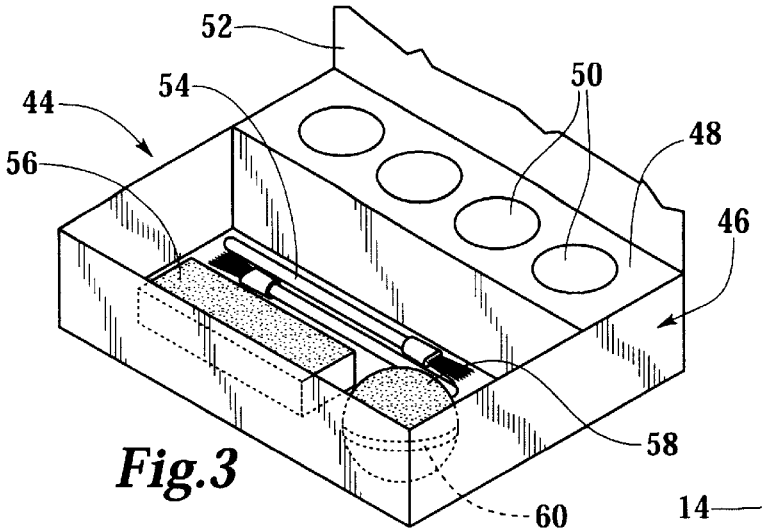
FIG. 3 is a top front perspective view, partially broken away, of a makeup case that, in combination with the barrel toy of FIG. 1, forms the kit of the invention.

According to another embodiment of the invention, a kit is provided that comprises barrel toy 10 as described above in combination with a clown makeup case 44 as depicted in FIGS. 2 and 3 and described herein. Referring to FIG. 1, in which makeup case 44 is shown in phantom outline so as not to obscure the underlying portion of barrel toy 10, makeup case 44 can be attached to, such as by taping, and displayed on barrel toy 10 to form the kit of the invention. This placement is desirable because of the great importance of both the barrel toy and the clown makeup to a child seeking to emulate a rodeo clown. Referring to FIG. 3, clown makeup case 44 preferably includes tray member 46 and lid 52, with tray 46 having disposed therein a stepped-up surface 48 comprising a plurality of recesses 50, each recess 50 containing a different color makeup of any commercially available type that is useful for creating a "clown face" on a child. Makeup case 46 preferably further comprises at least one applicator device useful for applying clown makeup from recesses 50 and at least one "bulbous clown nose" 60. Applicator devices can include, for example, brushes 54 and foam sponge block 56. As used herein, "bulbous clown nose" refers to any oversized, preferably polymeric, structure that can be releasably attached to the face of a child over his or her nose to simulate the nose of a clown face, and that can be but is not necessarily round. A satisfactory bulbous clown nose 60 useful in makeup case 46 is made by creating a slit 60 in a generally spherical, low density, solid foam ball that can be placed over the bridge of a child's nose without substantially impeding air flow through the child's nostrils.

Although the subject barrel toy and kit are described above in relation to their preferred embodiments, the invention disclosed herein is limited only by the broadest interpretation of the appended claims to which the applicant is legally entitled.

What is claimed is:

1. A barrel toy having a semi-rigid, generally cylindrical but slightly convex plastic sidewall with open top and bottom ends, interior and exterior surfaces, at least one unitarily molded, circumferentially extending rib, and an interior space sufficiently large to accommodate a child, a padded exterior surface section, a foam pad adhesively attached to the interior surface of the sidewall, and a decorative exterior covering.

2. The barrel toy of claim 1 wherein the plastic sidewall further comprises a plurality of longitudinally spaced, unitarily molded, circumferentially extending ribs.

3. The barrel toy of claim 1 wherein the padded exterior surface section comprises a polymeric foam layer that extends circumferentially around the sidewall and covers a section of the exterior surface that does not extend to either of the top and bottom ends.

4. The barrel toy of claim 1 wherein the top and bottom ends of the sidewall each comprises circumferentially extending split tubing disposed over the end.

5. The barrel toy of claim 4, wherein the decorative exterior covering comprises at least one layer of tape strips extending longitudinally between the top end and the bottom end, with the tape strips wrapping over the split tubing at the top end and at the bottom end.

6. The barrel toy of claim 1, wherein the decorative exterior covering comprises at least one layer of tape strips extending circumferentially around a portion of the plastic sidewll having the greatest outside diameter.

7. The barrel toy of claim 1, wherein the decorative exterior covering comprises at least one layer of tape strips extending longitudinally between the top end and the bottom end.

8. The barrel toy of claim 7 wherein the longitudinally extending tape strips wrap over the top end and the bottom end.

9. The barrel toy of claim 1, further comprising a split, plastic foam tube extending circumferentially around the top end and adhesively attached to the top end.

10. The barrel toy of claim 1 wherein the decorative exterior covering comprises designs.

11. The barrel toy of claim 10 wherein the designs are in the form of decals.

12. A kit comprising:

a clown barrel toy having a semi-rigid, generally cylindrical but slightly convex plastic sidewall with open top and bottom ends, interior and exterior surfaces, at least one unitarily molded, circumferentially extending rib, and an interior space sufficiently large to accommodate a child, a padded exterior surface section, a foam pad adhesively attached to the interior surface of the sidewall, and a decorative exterior covering; and a clown makeup case containing at least two different colors of facial makeup that can be safely applied to the facial skin of a child to emulate clown makeup, at least one makeup applicator device and at least one bulbous clown nose that can be temporarily applied to the nose of a child as part of the makeup.

* * * * *